United States Patent [19]

Nitta et al.

[11] 4,266,974

[45] May 12, 1981

[54] ALLOY STEEL POWDER HAVING EXCELLENT COMPRESSIBILITY, MOLDABILITY AND HEAT-TREATMENT PROPERTY

[75] Inventors: Minoru Nitta; Yoshihiro Kajinaga, both of Chiba; Ichio Sakurada, Ichihara; Kuniaki Ogura; Shunji Ito, both of Chiba, all of Japan

[73] Assignee: Kawasaki Steel Corporation, Kobe, Japan

[21] Appl. No.: 88,539

[22] Filed: Oct. 26, 1979

[30] Foreign Application Priority Data

Oct. 30, 1978 [JP] Japan ..... 53/133565

[51] Int. Cl.[3] ..... B22F 1/00

[52] U.S. Cl. ..... 75/251; 75/123 B; 75/123 L; 75/123 N; 75/123 J; 75/124; 75/125; 75/126 C; 75/126 E; 75/126 F; 75/126 H; 75/126 J; 75/126 P; 75/128 B; 75/128 F; 75/128 N; 75/128 G; 75/128 W; 75/128 V

[58] Field of Search ..... 75/123 N, 123 B, 123 J, 75/123 K, 123 L, 124, 125, 126 R, 126 C, 126 E, 126 F, 126 P, 126 J, 126 H, 128 B, 128 F, 128 N, 128 G, 128 W, 128 V, 251-255

[56] References Cited

U.S. PATENT DOCUMENTS

| | | | |
|---|---|---|---|
| 3,687,654 | 8/1972 | Huseby | 75/0.5 BA |
| 3,847,600 | 11/1974 | Mimino et al. | 75/126 C |
| 3,912,503 | 10/1975 | Schumacher et al. | 75/125 |
| 3,950,191 | 4/1976 | Ito et al. | 75/123 B |
| 4,001,052 | 1/1977 | Nakazato et al. | 75/123 B |
| 4,092,178 | 5/1978 | Onoe et al. | 75/123 B |
| 4,140,527 | 2/1979 | Kawai et al. | 75/126 J |

FOREIGN PATENT DOCUMENTS

| | | | |
|---|---|---|---|
| 1140573 | 7/1957 | France | 75/126 J |
| 45-36097 | 11/1970 | Japan | 75/126 J |
| 46-9540 | 3/1971 | Japan | 75/128 N |
| 440439 | 1/1975 | U.S.S.R. | 75/128 N |

OTHER PUBLICATIONS

Brown, G. T., et al.; "A Comparison of the Mechanical Properties of Some Powder-Forged and Wrought Steels", *Powder Metallurgy,* vol. 17, pp. 157-177 (1974).

Cundill, R. T., et al.; "Mechanical Properties of Sinter/-Forged Low Alloy Steels", *Powder Metallurgy,* vol. 13, pp. 165-194 (1970).

Batten, W. L.; "How to Do More with Prealloyed Powders", Metal Progress, pp. 105-112 (4/59).

*Primary Examiner*—Michael L. Lewis

*Attorney, Agent, or Firm*—Balogh, Osann, Kramer, Dvorak, Genova & Traub

[57] ABSTRACT

An alloy steel powder having a basic alloy composition, which is composed of at least one of manganese, chromium, molybdenum and vanadium, and the remainder being iron, and having low carbon, nitrogen and oxygen contents is excellent in the compressibility and moldability at the press molding and further excellent in the carburizing property and hardenability in its sintered steel or powder forged steel.

2 Claims, 10 Drawing Figures

ALLOY STEEL POWDER HAVING EXCELLENT COMPRESSIBILITY, MOLDABILITY AND HEAT-TREATMENT PROPERTY

BACKGROUND OF THE INVENTION (1) Field of the Invention

The present invention relates to an alloy steel powder having excellent compressibility and moldability and further having excellent heat-treatment properties, that is, carburizing property and hardenability in its sintered steel or powder forged steel, which powder is used in the production of machine structural parts through the powder metallurgy.

In general, in the powder metallurgy, raw material steel powder is press molded to produce a green compact, the green compact is sintered and heat treated, and further the sintered body is subjected to coining, forging, heat-treatment, and occasionally cutting to produce a final product having a higher density and a higher strength.

Therefore, the raw material steel powder is demanded to have the following properties. When a green compact is produced by a press molding of the raw material steel powder, the steel powder must be excellent in the compressibility and moldability. While, in order to give a mechanical strength to the sintered steel or powder forged steel through sintering and heat-treatment, the sintered steel or powder forged steel must be excellent in the heat-treatment properties, such as sinterability, uniform texture-formable property, carburizing property, nitriding property, hardenability and the like, and when the sintered body is subjected to a mechanical working, the sintered body must be excellent in the machinability. The present invention relates to an alloy steel powder which satisfies the above described demands in the use as a raw material powder for the production of alloy steel for machine structural parts.

(2) Description of the Prior Art

There have recently been developed various technics for strengthening the materials for iron series sintered machine parts produced from various alloy steel powder through the powder metallurgy, for example, a technic for producing alloy steel powder by the water-spray method, a technic for deoxidizing and annealing water-hardened unannealed steel powder, and the like. Such machine part is, for example, engine part, which is required to have high heat-resistance, abrasion resistance and oxidation resistance. Further, there has been developed a technic for producing large size machine parts, wherein pure iron powder used as a main raw material is mixed with various metal and non-metal powders, such as graphite powder, cobalt powder, nickel powder and other metal powder and alloy powder thereof, the resulting mixture is sintered to produce a machine part, and the machine part is subjected to heat-treatment, such as carburization hardening and the like. The inventors have made various investigations in order to meet these demands and accomplished the present invention.

SUMMARY OF THE INVENTION

The object of the present invention is to provide an annealed alloy steel powder having excellent compressibility and moldability at the press molding in a mold, and further having excellent carburizing property and hardenability in its sintered steel or powder forged steel, which powder has a basic composition, which is composed of at least one of manganese, chromium, molybdenum and vanadium, and the remainder being iron, contains occasionally commonly known elements and has low carbon content, low nitrogen content and low oxygen content.

That is, the feature of the present invention is the provision of an alloy steel powder having excellent compressibility, moldability and heat-treatment property, consisting of not more than 0.05% by weight of carbon, not more than 0.0040% by weight of nitrogen, not more than 0.10% by weight of silicon, not more than 0.01% by weight of aluminum, not more than 0.25% by weight of oxygen, at least one of 0.35–1.50% by weight of manganese, 0.2–5.0% by weight of chromium, 0.1–7.0% by weight of molybdenum and 0.01–1.0% by weight of vanadium, and the remainder being iron and incidental impurities, and having a green density of at least 6.60 g/cm$^3$ and a rattler value of not higher than 1.20% in the green compact produced therefrom under a molding pressure of 5 ton/cm$^2$.

As a commercial scale method of producing an alloy steel powder for machine structural parts, there is generally used a water-spraying method, wherein a molten steel previously melted and refined in an industrial furnace so as to have an aimed alloy composition is flowed down through a nozzle in the form of a column-like thin stream, and a high-pressure water is blown to the falling down molten steel from the surrounding to atomize and crush the steel, thereby finely divided water-hardened steel powder is produced. The unannealed steel powder obtained in the above described water-spraying method contains a large amound of carbon, which has been added to the molten steel, and a large amount of nitrogen, which has been absorbed in the molten steel during the melting and refining step and water-spraying step. Further, the surface of the particles of the steel powder have an oxide film and a water-hardened texture, and therefore the particles are hard. Accordingly, the unannealed steel power is difficult to be press molded and often damages the mold, and the green compact produced from the steel powder can not be fully deoxidized and sintered in the sintering step. Therefore, a machine part having a high strength can not be produced from the sintered body. Accordingly, in the conventional water-spraying method, it is difficult to produce a fully annealed steel powder having low contents of carbon, nitrogen and oxygen by subjecting the unannealed steel powder to a reduction annealing (final reduction annealing).

As the raw material alloy steel powder for the powder metallurgy (inclusive of preform forging and powder forging), there have been commonly known AISI 4600 (0.2% Mn-2.0% Ni-0.5% Mo), AISI 9400 (0.25% of each of Mn, Cr and Mo), AISI 8600 (0.2% Mn-0.5% of each of Ni, Cr and Mo) and the like. However, AISI 4600 is excellent in the compressibility and moldability and further in the mechanical strength in its sintered body, but is poor in the heat-treatment properties, such as carburizing property, hardenability and the like, in its sintered body. While, AISI 9400 and AISI 8600, when they contain more than 0.20% of oxygen, are poor in the mechanical strength and carburizing property in their sintered body. These conventional alloy steel powders can not satisfy fully the above described demands.

The alloy steel powder of the present invention has been produced in order to satisfy the above described two contradictory demands, and has most suitable properties to be used as a raw material alloy steel powder, which can be forged into a high-density steel having a density near the true density. Moreover, the alloy steel powder of the present invention contains manganese and chromium as the alloy element, and therefore the alloy steel powder is inexpensive and excellent to be used as a starting steel powder in the commercial scale mass production of machine parts.

DESCRIPTION OF THE PREFERRED EMBODIMENTS

Figure 1:
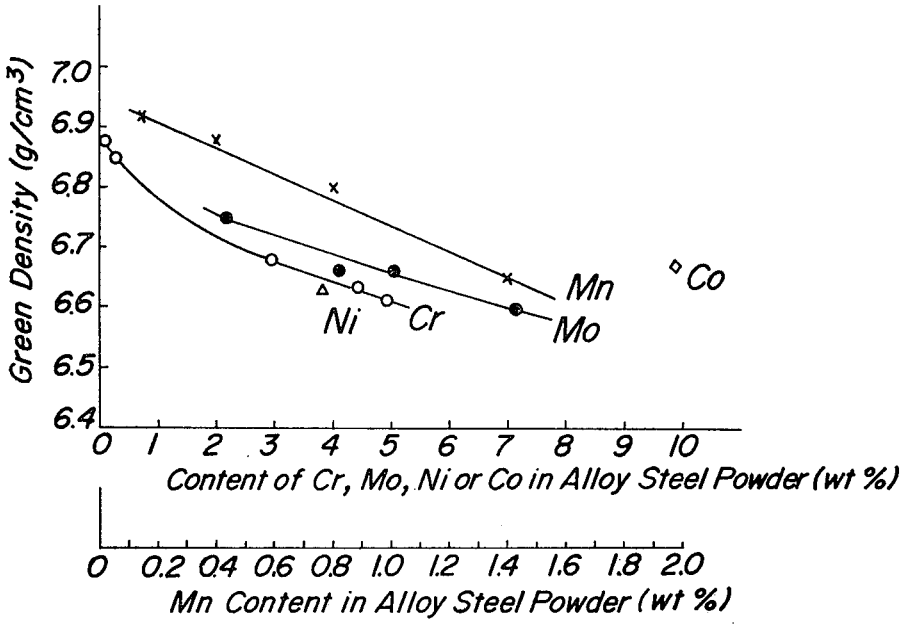
FIG. 1 is a graph illustrating a relation between the amount of each of manganese, chrominum, molybdenum, nickel and cobalt alloyed in a steel powder and the green density of the alloyed steel powder.

The alloy steel powder of the present invention can be produced through the following production steps.

(1) Melting and refining (adjustment of alloy components) step:

A molten steel is produced from commonly known raw materials through a commonly known melting technic by means of an ordinary industrial furnance, such as converter, open herth furnace, electric furnace, induction furnace or the like. In this case, slag is occasionally refined. Further, alloy components other than oxygen, carbon and incidental impurities, are alloyed to the raw material to produce a molten steel having the same composition as that of the final product in order to form uniform texture. However, in this alloying, the following points must be taken care of. In the final reduction annealing step for unannealed steel powder, oxygen present as a surface oxide of the unannealed steel powder must be removed from the steel powder in the form of a CO gas by the previously alloyed carbon, and therefore the amount of carbon to be alloyed to the molten steel must be determined depending upon the amount of oxygen, though the surfaces of unannealed steel powder particles are oxidized water atomization. That is, the molar ratio of C/O (total oxygen in the unannealed steel powder) must be not higher than 1. In other words, carbon content in the molten steel must satisfy the condition of $|(\text{total amount of oxygen in the unannealed steel powder})\times(12/16)-0.05| \leqq [\{(\text{total amount of oxygen in the unannealed steel powder})-0.25\}\times(12/16)]$ in the fundamental deoxidation and decarburization formula of $MO+C \rightarrow M+CO$. When the amount of carbon contained in the unannealed steel powder is excess based on the total amount of oxygen contained therein, the unannealed steel powder is again oxidized or is mixed with another unannealed steel powder having the same composition as that of the former unannealed steel powder but containing an excess amount of oxygen. Alternatively, when the amount of carbon in the unannealed steel powder is short based on the total amount of oxygen contained therein, graphite powder or oil is added to the unannealed steel powder as a carbon source or the unannealed steel powder is mixed with another unannealed steel powder having the same composition as that of the former steel powder but containing an excess amount of carbon.

(2) Molten steel-pouring step:

This step is carried out in combination with the water-spraying step explained later. That is, in this step, a molten steel is poured into a turn dish under an inert gas atmosphere, such as nitrogen, argon or the like, or under a non-oxidizing atmosphere. In this step, it is necessary that the oxidation of molten steel is prevented not to form oxide series inclusions in the steel powder matrix, and that the consumption of alloy metal is prevented. Further, in this step, the amount of alloy elements, such as carbon, chromium, manganese, vanadium, niobium, titanium, boron, sulfur and the like, which are alloyed in a relatively small amount or is poor in the yield at the melting is adjusted.

(3) Water-spraying step:

In this step, the molten steel poured into the turn dish is flowed out from the nozzle arranged at the bottom of the turn dish into a spraying tank in the form of a column-likely falling down stream, and a high-speed water jet is blown to the stream of the molten steel from the surrounding to atomize and crush the molten steel into fine powders, and the fine powders are cooled by the sprayed water and other cooling water to produce a water-hardened alloy steel powder. In this step, when an airtight or substantially airtight spraying tank is used and the atomization and crushing are carried out under the above described inert gas atmosphere or non-oxidizing atmosphere, the amount of carbon contained in the alloy steel can be decreased. Moreover, the deoxidation and decarburization time in the final reduction annealing step can be shortened, the total oxygen content in the annealed alloy steel powder can be decreased, the installation cost and operation cost of the reduction annealing furnace can be saved, and troubles in the final reduction annealing can be decreased. Accordingly, it is necessary that the increasing of the amount of oxygen in the steel in this water-spraying step is not caused by oxygen other than the oxygen formed by the decomposition of steam. It is necessary to control oxygen and hydrogen contents in the spraying atmosphere.

(4) Dehydrating and drying step:

In this step, the above described unannealed steel powder is recovered from the spraying water and cooling water, dehydrated and dried by commonly known methods and apparatuses. The recovery of the steel powder from water and the drying thereof are generally carried out at room temperature in a short period of time, and therefore the steel powder is not substantially oxidized. However, when a vacuum dehydration is carried out, the steel powder is sometimes oxidized by the air suctioned and therefore the vacuum dehydration must be carefully carried out.

In the drying step, the steel powder is often oxidized due to the use of a heat source kept at several hundreds degree in centigrade in view of commercial production of the aimed alloy steel powder. Therefore, the drying step is carried out at a temperature of not higher than 200° C. under an inert gas atmosphere or a non-oxidizing gas atmosphere. However, even when the steel powder is oxidized in this step, the resulting oxides are mainly FeO(OH), $Fe_2O_3$ and the like, and therefore these oxides do not cause serious troubles in the reduction annealing.

(5) Reduction annealing step:

This step is the most important step in the production of the steel alloy powder of the present invention. The molar ratio of C/O in the above obtained unannealed steel powder is adjusted to not higher than 1.0, that is, the amount of alloyed carbon in the steel is adjusted within the range of $|(\text{total amount of oxygen in the unannealed steel powder})\times(12/16)-0.05| \leqq [\{(\text{total amount of oxygen in the unannealed steel powder})-0.25\}\times(12/16)]$, and the steel powder is subjected to an induction heating in a non-oxidizing gas atmosphere kept at a dew point of not higher than +5° C. under a reduced pressure of not higher than 100 Torr, preferably not higher than 100 Torr having a theoretical oxygen partial pressure of $2.1\times10^{-1}$ Torr. In this induction heating, the unannealed steel powder is heated at a temperature of 1,000°-1,400° C. for a period of from several minutes to several hours by means of an alternate current having a frequency of from 50 Hz to 500 KHz, whereby the unannealed steel powder is fully annealed and occurrently deoxidized, decarburized and denitrified to produce a sintered cake. The cake is cooled and pulverized to obtain an alloy steel powder having a low oxygen content of not higher than 0.25%, a low carbon content of not higher than 0.05% and a low nitrogen content of not higher than 0.0040%.

In the above described induction heating, the metal powder is heated by a Joule's heat generated by the eddy current induced in the metal portion in the interior of the powder particles. Since heat is generated in the particles themselves, alloyed carbon is rapidly dispersed in the interior of the particles to promote the reduction reaction at the interface between the carbon and the oxide film. Accordingly, pressure increases vary rapidly due to the gas formed at the intersurface. Particularly, since the exterior of the particles is kept under vacuum, the gas formed at the reduction is rapidly liberated to the exterior of the particles. In this case, nitrogen solid solved in the particles or present in the form of nitride in the particles is decomposed and liberated. Moreover, arc discharge occurs between fellow particles due to the eddy current generated in the metal portion in the interior of the particles, and high temperature portions are formed locally. As the result, a high temperature is easily obtained by the induction heating system, but when the temperature exceeds 1,400° C., fellow particles are excessively sintered, and the sintered cake is difficult to be pulverized.

In the reduction of $SiO_2$ by carbon at a reducing temperature of 1,350° C., CO gas formed by the reduction has a partial pressure of $5.8\times10$ Torr. It can be seen from this reduction that FeO, MnO, $Cr_2O_3$, $SiO_2$ and the like are easily reduced, and alloy steel powders containing niobium, boron, titanium, tungsten and the like, which constitute hardly reducible oxides, can be produced.

In this reduction annealing step, heating of the alloy steel powder can be carried out without any serious troubles by means of any conventional methods and apparatuses in addition to the induction heating system. However, when a gas-reduction method, wherein a reducing gas, such as hydrogen, is used as a reducing agent, and a mixture of the reducing gas and unannealed steel powder is indirectly heated to effect a deoxidation, decarburization and denitrification, is carried out, the dew point of the reducing gas must be not higher than −40° C. Further, the gas-reduction method has the following drawbacks. Carbon can not be removed to an amount lower than a certain limit under such low dew point atmosphere, and moreover the carbon content in the un-annealed steel powder is previously decreased to not higher than 0.20%, preferably not higher than 0.10%, in order to decrease the carbon content in the annealed steel powder to not higher than 0.05%. Therefore, the above described induction heating system is preferable.

Further, there can be used a method, wherein oxides are directly reduced by carbon alloyed in the steel powder under an inert gas atmosphere, but when it is intented to carry out this direct reduction method by the external heating system, there are various factors for limiting the commercial scale installation.

(6) Crushing and sieving step:

In this step, the sintered cake obtained in the above described reduction annealing step is cooled and pulverized, and the resulting powder is sieved into proper particle size and particle size distribution depending upon the use purpose to produce an alloy steel powder of the final product. The sintered cake is pulverized by means of a conventional impact grinder.

In the present invention, carbon is previously alloyed to raw material steel powder based on the following reason. Carbon acts directly as a reducing agent in the reduction annealing, and further has a important role in the melting and refining step, molten steel-pouring step and water-spraying step.

That is, in the melting and refining step, when carbon is present, it is not necessary to select strictly scrap used as main raw material, and chips and coke powders can be used. Moreover, the addition of carbon to the raw material steel powder can save heat at the melting and refining of raw material steel powder, can prevent the molten steel from being excessively oxidized, and to improve the yield of manganese, chromium, vanadium, niobium, boron, titanium and the like in the melting step.

In the molten steel-pouring step, the presence of carbon in the molten steel can decrease the viscosity of the molten steel and can prevent the deposition of oxides ($FeCr_2O_4$ and the like) formed due to the lowering of the temperature of the molten steel. Therefore, clogging of nozzle of the turn dish and corrosion of refractories due to the adhesion of the above formed oxides do not occur, and the molten steel can be stably flowed out from the nozzle of the turn dish into the spraying tank.

In the water-spraying step, the presence of carbon in the molten steel acts as follows. When high pressure water is blown to the column-likely falling down stream of the molten steel from its surrounding to atomize and pulverize the molten steel, CO gas is generated from the molten steel and suppress the oxidation of the molten steel during the spraying of water. This action of carbon appears noticeably when the amount of carbon alloyed in the molten steel is not less than 0.05%.

Then, an explanation will be made with respect to the role of each alloyed element in the alloy steel powder according to the present invention and to the reason of the limitation of the content of each alloyed element in the alloy steel powder.

(A) As to the carbon content of not higher than 0.05%, the nitrogen content of not higher than 0.0040% and the oxygen content of not higher than 0.25%:

Carbon is generally interstitially solid solved in a steel together with nitrogen to harden the ferrite matrix.

When alloy steel powders are press molded into green compacts in a mold by the powder metallurgy, if the molding pressure is constant, a green compact having a higher density has a lower rattler value, a higher traverse bending strength and a more excellent moldability. Therefore, a sintered body produced from the green compact having a high density has naturally a high density, and can be made into a machine part having an excellent mechanical property and a high dimensional accuracy. Moreover, when a preliminarily heated green compact is hot forged to produce a steel having a true density or a density near the true density, the use of a green compact having a higher density makes use of a lower forging pressure. Based on the above described reason, the aimed alloy steel powder according to the present invention is limited to one having a density of at least 6.60 g/cm$^3$ and a rattler value of not higher than 1.20% in the green compact produced therefrom under a molding pressure of 5 ton/cm$^2$.

In order to satisfy the above described condition, it is necessary that the carbon content of the alloy steel powder is not higher than 0.05% and the nitrogen content thereof is not higher than 0.0040%. In the present invention, since a molten steel can be refined by the alloyed carbon, an alloy steel powder having a very low content of oxide series inclusions can be produced, and further substantially all the oxygen in the alloy steel powder is present in the surface thereof, and therefore the alloy steel powder matrix is not hardened. That is, in the present invention, oxygen does not substantially influence the compresibility and moldability of the alloy steel powder. However, when the total amount of oxygen contained in the alloy steel powder exceeds 0.25%, the final products of a sintered body and a forged body are low in the mechanical strength and is poor in the heat-treatment properties, such as carburizing property, hardenability and the like. It is preferable that alloy steel powder contains smaller amount of carbon, nitrogen and oxygen, and therefore in the present invention, it is not necessary that the lower limits of carbon, nitrogen and oxygen are not defined.

The carbon content in the sintered body and forged body can be adjusted by mixing the alloy steel powder of the present invention with graphite powder. When the alloy steel powder having an oxygen content as low as not higher than 0.25% of the present invention is mixed with graphite powder, and the resulting mixture is compressed, molded and sintered, carbon disperses rapidly, and the loss of carbon is very small. This fact means that, in the production of a sintered body or forged body, carbon can be accurately alloyed to the alloy steel powder and further the resulting sintered body and forged body have a uniform texture.

(B) As to the limitation of silicon content of not higher than 0.10% and aluminum content of not higher than 0.01%:

In the alloy steel powder according to the present invention, it is necessary to suppress the silicon content to not higher than 0.10% and the aluminum content to not higher than 0.01%. In general, when silicon content in a steel powder exceeds 0.10%, the amount of oxygen contained in the steel powder increases to form manganese silicate series complex oxides and to cause difficulties in the deoxidation by the reduction annealing. Further, silicon has a high solid solution hardening effect, and a steel powder containing more than 0.10% of silicon is very low in the green density, and is oxidized with water or oxygen contained in the sintering atmosphere to cause extraordinary expansion of the resulting sintered body. Accordingly, it is necessary that silicon is fully removed from steel in the melting and refining step so that the molten steel contains a small amount of not more than 0.05% of silicon.

The aluminum content in the alloy steel powder of the present invention must be as low as not higher than 0.01% due to the same reason as that in the case of silicon. When more than 0.01% of aluminum is contained in a molten steel, nozzle is clogged at the pouring of the molten steel, and further aluminum is predominantly oxidized in the water-spraying, reduction annealing and sintering steps to deteriorate mechanical properties of the sintered body and forged body.

(C) As to the limitation of manganese content of 0.35–1.50% and chromiun content of 0.2–5.0%:

Manganese and chromium are essential elements in order to improve the mechanical properties of iron and steel, and are basic alloy elements in the sintered body and forged body. That is, manganese is one of the most effective alloy elements for improving the hardenability of steel. The improvement of strength of steel by the alloying of manganese is due to the solid solution hardening effect and to the spherodizing effect of manganese carbide by a heat treatment, such as low temperature tempering or the like. However, when the manganese content in a steel is higher than 1.50%, a large amount of oxide is formed during the water-spraying, and the reduced and annealed steel powder is apt to contain a large amount of oxygen. Due to this reason, the steel matrix is strengthened by manganese to increase the hardness of the steel powder and to lower the green density. Particularly, manganese has a high influence upon the green density, and when more than 1.50% of manganese is alloyed to steel, a green compact having a green density of at least 6.60 g/cm$^3$ can not be obtained under a molding pressure of 5 ton/cm$^2$. While, sintered bodies and forged bodies are often required to be subjected to mechanical workings, such as drilling, grooving, screw-threading, surface grinding and the like, due to the dimensional accuracy of the sintered or forged bodies or to unavoidable circumstances. It this case, the workability can be improved by the addition of sulfur to the steel. Accordingly, sulfur is generally added to molten steel in an amount of 0.05–0.25%. However, it is preferable to add 0.05–0.10% of sulfur to molten steel in order not to deteriorate the compressibility of the resulting alloy steel powder. Based on the above described reason, it is necessary to use manganese in an amount of as large as more than 3 times of the amount of sulfur. Further, the lower limit of the effective amount of manganese for improving the property of sintered steel or powder forged steel by hardening-tempering is 0.35%.

Chromium is used alone or in combination with the above described manganese, and improves the hardenability, mechanical strength, oxidation resistance and abrasion resistance of sintered body. Further, chromium is an indispensable element in the heat treatments, such as carbonitriding and the like, of sintered body. The carburized layer improves the strength, oxidation resistance and abrasion resistance of sintered body, and the non-carburized layer improves the hardenability, strength and toughness of sintered body. In this case, the lowest amount of chromium effective for the carbonitriding is 0.2%. The carbonitriding effect of chromium increases as the increase of the amount of chromium alloyed to steel, but when more than 5.0% of chromium is alloyed to steel, the resulting alloy steel powder is hard due to the solid solution hardening effect of chromium and the green density thereof is low.

(D) As to the limitation of molybdenum content of 0.1–7.0% and vanadium content of 0.01–1.0%:

Molybdenum is very effective for decreasing the critical cooling rate of sintered body similarly to manganese and chromium, and is most effective for increasing the quench hardening depth, for relaxing the temper brittleness and for improving the high-temperature strength of sintered body. Molybdenum exhibits these effects by the use of a very small amount. It has been found by experiments that the lower limit value of the effective amount of molybdenum for improving the hardenability of sintered body is 0.10%, and a reduced and annealed steel powder consisting of 0.42% of manganese, 4.53% of molybdenum and the remainder being iron and incidental impurities has a remarkably high green density of 6.70 g/cm$^3$ under a molding pressure of 5 ton/cm$^2$. However, an alloy steel powder containing more than 7.0% of molybdenum is apt to lower the compressibility.

Vanadium is effective for improving the high-temperature strength of sintered body, and is formed into carbide, which gives abrasion resistance to the sintered body. These effects are more improved when vanadium is used together with chromium and molybdenum. The high-temperature tensile strength of sintered body increases corresponding to the addition amount of vanadium. However, alloy steel powder having a vanadium content of higher than 1.0% is poor in the conpesibility, and therefore the optimum range of vanadium content in alloy steel powder is 0.01–1.0%.

(E) As to the boron content of not higher than 0.02%, nickel content of 0.2–5.0%, copper content of 0.2–2.0%, cobalt content of 0.2–10.0% and niobium content of not higher than 0.10:

These elements are added to an alloy steel powder having the basic alloy composition consisting of the above described alloy components (A)-(D) according to the present invention in order to more improve, by the use of a proper amount, the heat-treatment properties, such as hardenability, cabonitriding property and the like, and the oxidation resistance, abrasion resistance and other properties at high temperature of the sintered body without deteriorating the compressibility of the powder.

Copper improves remakably the hardenability and increases remarkably the quench-hardening depth by the coexistence with carbide-forming elements, such as manganese, chromium, molybdenum and the like. Copper promotes graphitization similarly to nickel, but at the same time serves to prolong the time required for starting the perlite-forming reaction, and improves the hardenability. In order to improve the hardenability, more than 0.20% of copper is necessary, but when alloy steel powder contains more than 2.0% of copper, the steel powder is hard and is poor in the compressibility.

Nickel strengthens ferrite and improves the toughness thereof, and improves the strength and corrosion resistance at high temperature. The use of 0.2% of nickel is effective for improving the hardenability and as the alloyed amount of nickel increases, the high-temperature strength increases. However, even when the alloyed amount of nickel is more than 5.0%, the effect does not so improve, but rather the compressibility is deteriorated.

Cobalt deteriorates the hardenability, but the addition of a small amount of copper to alloy steel powder can give a satisfactorily high hardenability to the resulting sintered body. Further, when cobalt is added to alloy steel powder together with carbide-forming elements, such as chromium, molybdenum and the like, the oxidation resistance and high-temperature strength of the resulting sintered body are improved. Moreover, cobalt solves in ferrite but cobalt does not cause the ferrite matrix, and therefore the compossibility of alloy steel powder is not so deteriorated. Accordingly, the cobalt content in the alloy steel powder of the present invention is preferably 0.2–10.0% in view of the corrosion resistance against lead, oxidation resistance and commercial purpose.

Boron and niobium are effective for improving the hardenability by the use of a small amount, and therefore manganese, chromium and molybdenum can be saved. Moreover, the use of boron and niobium makes possible to carry out the nitriding reaction without deteriorating the carbonizing property. However, the use of more than 0.02% of boron or more than 0.10% of niobium does not so improve the hardenability nor exhibits nitriding effect. Accordingly, the upper limit of boron is set to 0.02% and that of niobium is set to 0.10% in the present invention.

The following examples are given for the purpose of illustration of this invention and are not intended as limitations thereof.

All the alloy steel powders shown in the examples were produced through the above described water-spraying and reduction annealing steps. That is, a molten steel previously melted and refined so as to have an aimed alloy composition was poured into a previously heated turn dish so that the molten steel would be flowed out from a nozzle, which was provided at the bottom of the turn dish, into a spraying tank in the form of a column-likely falling down stream having a diameter of 6–20 mm. A high-pressure water kept under a pressure of 30–180 kg/cm$^2$G was blown to the column-likely falling down stream from its surrounding to atomize and crush the molten steel. In the above described treatment, the pouring of the molten steel and the water-spraying were carried out under a nitrogen atmosphere having an oxygen concentration of not higher than 0.4% by volume. Recovered powder was dehydrated, and then dried, while keeping substantially free from oxygen under nitrogen atmosphere, to obtain an unannealed steel powder. The unannealed steel powder was subjected to a reduction annealing treatment under the reduction annealing condition shown in the following Table 1, whereby the unannealed steel powder was deoxidized, decarburized and denitrified.

The reduction annealing condition shown in Table 1 is as follows.

Condition V: vacuum induction heating

Condition B: heating at 1,000° C. for 2.5 hours under an ammonia decomposition gas having a dew point of from 0° to 10° C. in a belt furnace Condition H: heating at 1,000° C. for 2.5 hours in purified hydrogen The resulting sintered cake was pulverized by means of an impact grinder, and then sieved to obtain the annealed alloy steel powder (Examples 1–21: alloy steel powder of the present invention, Examples 22–29: comparative alloy steel powder).

The chemical analysis value, particle size distribution, apparent density and fluidity of the above obtained alloy steel powders are shown in Table 1. Further, the alloy steel powder was mixed with 1% of zinc stearate as a lubricant and press molded under a pressure of 5 ton/cm$^2$ according to "Test method of compressibility of metal powder" defined in JSPM Standard 1–64 without lubrication of the inner wall of the press mold to produce a green compact, and the green density of the green compact was measured. Further, the rattler value of the green compact was measured according to "Rattler test for metal green compact" defined in JSPM Standard 4–69. The green density and rattler value of the green compact are also shown in Table 1.

It can be seen from Table 1 that all the alloy steel powders of the present invention have a carbon content of not higher than 0.05%, a nitrogen content of not higher than 0.0040% and an oxygen content of not higher than 0.25%, and have a green density of at least 6.60 g/cm$^3$ in the green compact formed under a molding pressure of 5 ton/cm$^2$.

TABLE 1 (a)-1

| | Example | Chemical analysis value (wt %) | | | | | | | | | | | | | | | | |
|---|---|---|---|---|---|---|---|---|---|---|---|---|---|---|---|---|---|---|
| | | C | N (total) | O | Si | Mn | P | S | Ni | Cr | Mo | Cu | Co | V | B, | Nb | Sol. Al | Insol. Al |
| Alloy steel powder of the present invention | 1 | 0.004 | 0.0028 | 0.241 | 0.011 | 0.80 | 0.020 | 0.020 | — | — | — | — | — | — | — | — | 0.00 | ≦0.001 |
| | 2 | 0.019 | 0.0016 | 0.174 | 0.016 | 0.24 | 0.031 | 0.021 | — | 2.92 | — | — | — | — | — | — | ≦0.001 | ≦0.001 |
| | 3 | 0.012 | 0.0012 | 0.240 | 0.031 | 0.21 | 0.027 | 0.017 | — | 4.79 | — | — | — | — | — | — | ≦0.001 | ≦0.001 |
| | 4 | 0.002 | 0.0018 | 0.138 | 0.006 | 0.21 | 0.033 | 0.024 | — | — | 2.11 | — | — | — | — | — | ≦0.001 | ≦0.001 |
| | 5 | 0.003 | 0.0019 | 0.123 | 0.007 | 0.21 | 0.031 | 0.022 | — | — | 4.08 | — | — | — | — | — | ≦0.001 | ≦0.001 |
| | 6 | 0.007 | 0.0015 | 0.112 | 0.005 | 0.12 | 0.035 | 0.027 | — | — | 5.01 | — | — | — | — | — | ≦0.001 | ≦0.001 |
| | 7 | 0.002 | 0.0010 | 0.123 | 0.002 | 0.16 | 0.038 | 0.026 | — | — | 7.14 | — | — | — | — | — | ≦0.001 | ≦0.001 |
| | 8 | 0.019 | 0.0008 | 0.136 | 0.010 | 0.21 | 0.035 | 0.026 | 3.80 | — | — | — | — | — | — | — | ≦0.001 | ≦0.001 |
| | 9 | 0.006 | 0.0008 | 0.108 | 0.002 | 0.15 | 0.026 | 0.017 | — | — | — | — | 9.83 | — | — | — | ≦0.001 | ≦0.001 |
| | 10 | 0.013 | 0.0008 | 0.184 | 0.011 | 0.68 | 0.015 | 0.022 | — | 1.15 | 0.21 | — | — | — | — | — | ≦0.001 | ≦0.001 |
| | 11 | 0.021 | 0.0008 | 0.098 | 0.016 | 0.40 | 0.015 | 0.022 | 0.51 | 1.01 | 0.26 | — | — | — | — | — | ≦0.001 | ≦0.001 |
| | 12 | 0.010 | 0.0008 | 0.124 | 0.020 | 1.10 | 0.028 | 0.019 | 0.52 | 0.47 | 0.51 | 0.52 | — | — | — | — | 0.002 | 0.001 |
| | 13 | 0.026 | 0.0011 | 0.218 | 0.003 | 0.89 | 0.033 | 0.015 | — | 0.55 | — | — | — | — | — | — | ≦0.001 | ≦0.001 |
| | 14 | 0.007 | 0.0016 | 0.156 | 0.002 | 0.37 | 0.031 | 0.022 | 3.83 | 0.52 | — | — | — | — | — | — | 0.002 | <0.001 |
| | 15 | 0.010 | 0.0010 | 0.171 | 0.005 | 0.58 | 0.033 | 0.023 | 1.92 | 0.62 | 0.26 | — | — | — | — | — | 0.002 | <0.001 |
| | 16 | 0.015 | 0.0013 | 0.172 | 0.017 | 0.17 | 0.033 | 0.022 | — | 3.12 | 1.04 | — | — | — | — | — | 0.002 | <0.001 |
| | 17 | 0.015 | 0.0008 | 0.213 | 0.028 | 0.17 | 0.015 | 0.015 | — | 3.56 | 0.39 | — | — | 0.32 | — | — | ≦0.001 | ≦0.001 |
| | 18 | 0.004 | 0.0037 | 0.162 | 0.015 | 0.15 | 0.015 | 0.020 | 1.52 | 1.50 | — | 0.20 | 6.66 | — | — | — | 0.008 | 0.002 |
| | 19 | 0.003 | 0.0012 | 0.158 | 0.010 | 0.42 | 0.030 | 0.019 | — | — | 4.53 | — | — | — | — | — | ≦0.001 | ≦0.001 |
| | 20 | 0.010 | 0.0008 | 0.218 | 0.022 | 0.76 | 0.028 | 0.019 | — | 1.16 | 0.25 | — | — | — | B — | 0.0046 | 0.001 | 0.001 |
| | 21 | 0.015 | 0.0008 | 0.193 | 0.015 | 0.80 | 0.029 | 0.019 | — | 1.04 | 0.25 | — | — | — | — | Nb 0.043 | 0.001 | 0.001 |
| Comparative alloy steel powder | 22 | 0.12 | 0.026 | 0.528 | 0.016 | 0.24 | 0.031 | 0.021 | — | 2.92 | — | — | — | — | — | — | ≦0.001 | ≦0.001 |
| | 23 | 0.20 | 0.047 | 0.448 | 0.031 | 0.21 | 0.027 | 0.017 | — | 4.79 | — | — | — | — | — | — | ≦0.001 | ≦0.001 |
| | 24 | 0.011 | 0.0046 | 0.109 | 0.003 | 0.05 | 0.013 | 0.017 | — | — | 5.33 | — | — | — | — | — | ≦0.001 | ≦0.001 |
| | 25 | 0.006 | 0.0010 | 0.469 | 0.002 | 0.15 | 0.026 | 0.017 | — | — | — | — | 9.83 | — | — | — | ≦0.001 | ≦0.001 |
| | 26 | 0.054 | 0.0202 | 0.572 | 0.014 | 0.84 | 0.015 | 0.024 | — | 0.98 | 0.25 | — | — | — | — | — | ≦0.001 | ≦0.001 |
| | 27 | 0.17 | 0.0214 | 0.383 | 0.032 | 0.86 | 0.015 | 0.014 | — | 1.02 | 0.24 | — | — | — | — | — | ≦0.001 | ≦0.001 |
| | 28 | 0.014 | 0.0108 | 0.592 | 0.003 | 0.39 | 0.030 | 0.020 | 4.03 | 0.70 | — | — | — | — | — | — | 0.002 | <0.001 |
| | 29 | 0.010 | 0.0220 | 0.552 | 0.017 | 0.17 | 0.033 | 0.022 | — | 3.12 | 1.04 | — | — | — | — | — | 0.002 | <0.001 |

TABLE 1(b)-1

| | Example | Apparent density (g/cm$^3$) | Fluidity (sec/50gr) | Particle size distribution (mesh) (wt %) 60/80 | 80/100 | 100/150 | 150/200 | 200/250 | 250/325 | <325 | Property of green compact: Green density (g/cm$^3$) | Rattler value (%) | Reduction annealing condition |
|---|---|---|---|---|---|---|---|---|---|---|---|---|---|
| Alloy steel power of the present invention | 1 | 3.33 | 19.4 | 0.2 | 5.1 | 23.5 | 21.1 | 17.3 | 12.3 | 20.5 | 6.80 | 1.08 | B |
| | 2 | 2.69 | 25.1 | 1.8 | 7.1 | 15.2 | 25.2 | 20.0 | 10.8 | 19.9 | 6.68 | 0.60 | V |
| | 3 | 2.82 | 22.9 | 1.6 | 6.3 | 14.8 | 23.7 | 21.4 | 13.6 | 18.6 | 6.62 | 0.68 | |
| | 4 | 2.97 | 23.8 | 0.4 | 5.7 | 19.4 | 27.8 | 22.6 | 9.3 | 14.8 | 6.75 | 0.71 | H |
| | 5 | 2.54 | 26.1 | 0.3 | 6.5 | 18.0 | 27.6 | 19.3 | 11.4 | 16.9 | 6.66 | 0.55 | |
| | 6 | 2.70 | 24.8 | 0.7 | 6.8 | 18.5 | 27.5 | 19.9 | 11.2 | 15.4 | 6.66 | 1.08 | |
| | 7 | 2.71 | 25.1 | 0.3 | 4.5 | 13.8 | 21.6 | 22.4 | 10.5 | 26.9 | 6.60 | 1.18 | |
| | 8 | 2.62 | 25.2 | 0.2 | 3.2 | 11.4 | 25.8 | 22.4 | 13.9 | 23.1 | 6.63 | 1.05 | |
| | 9 | 2.74 | 24.2 | 0.3 | 7.5 | 17.2 | 29.2 | 19.1 | 10.5 | 16.4 | 6.67 | 0.65 | |
| | 10 | 3.08 | 21.7 | 11.0 | 12.1 | 27.8 | 22.4 | 9.1 | 10.3 | 7.3 | 6.69 | 0.78 | |
| | 11 | 2.91 | 22.3 | 9.7 | 11.2 | 22.3 | 23.5 | 12.4 | 11.2 | 9.7 | 6.62 | 0.52 | V |
| | 12 | 3.02 | 24.0 | 13.2 | 12.9 | 23.0 | 21.2 | 9.7 | 11.3 | 8.7 | 6.61 | 0.57 | |
| | 13 | 2.74 | 24.1 | 0.1 | 2.4 | 14.8 | 26.4 | 26.2 | 10.9 | 19.2 | 6.66 | 0.65 | |
| | 14 | 2.90 | 23.9 | 0.4 | 5.0 | 14.5 | 23.6 | 19.2 | 12.4 | 24.9 | 6.61 | 0.66 | |
| | 15 | 2.94 | 21.1 | 1.7 | 8.9 | 16.4 | 31.8 | 19.6 | 9.5 | 12.1 | 6.62 | 0.66 | |
| | 16 | 2.96 | 23.8 | 2.0 | 8.1 | 18.2 | 26.7 | 19.3 | 10.4 | 15.3 | 6.61 | 0.73 | V |

TABLE 1(b)-1-continued

| | Example | Apparent density (g/cm³) | Fluidity (sec/50gr) | Particle size distribution (mesh) (wt %) 60/80 | 80/100 | 100/150 | 150/200 | 200/250 | 250/325 | <325 | Property of green compact: Green density (g/cm³) | Rattler value (%) | Reduction annealing condition |
|---|---|---|---|---|---|---|---|---|---|---|---|---|---|
| Alloy steel powder of the present invention | 17 | 3.06 | 24.0 | tr | 6.3 | 19.3 | 16.6 | 18.2 | 21.0 | 18.6 | 6.60 | 0.31 | |
| | 18 | 2.94 | 26.1 | tr | 9.4 | 27.8 | 20.6 | 11.0 | 17.8 | 13.4 | 6.62 | 1.15 | B |
| | 19 | 2.81 | 23.8 | tr | 8.2 | 12.2 | 18.4 | 13.1 | 18.2 | 29.9 | 6.72 | 0.91 | |
| | 20 | 3.14 | 21.0 | 16.8 | 12.4 | 15.6 | 26.5 | 9.2 | 13.2 | 6.3 | 6.63 | 0.73 | V |
| | 21 | 3.05 | 21.8 | 7.5 | 10.8 | 21.5 | 25.7 | 9.2 | 10.0 | 15.3 | 6.61 | 0.65 | |
| Comparative alloy steel powder | 22 | 2.27 | 31.2 | tr | 1.2 | 1.8 | 18.3 | 19.3 | 15.9 | 37.5 | 6.37 | 0.30 | B |
| | 23 | 2.34 | 30.0 | tr | 0.8 | 7.6 | 17.7 | 20.4 | 18.0 | 35.5 | 6.21 | 0.44 | |
| | 24 | 3.45 | 18.5 | 0.7 | 5.5 | 24.5 | 31.0 | 18.0 | 10.8 | 9.5 | 6.54 | 1.41 | |
| | 25 | 2.50 | 25.3 | 1.4 | 6.2 | 13.7 | 24.7 | 19.4 | 10.7 | 23.9 | 6.64 | 0.55 | |
| | 26 | 2.94 | 22.0 | 1.5 | 3.5 | 18.2 | 21.0 | 26.0 | 9.8 | 20.0 | 6.50 | 0.95 | |
| | 27 | 3.08 | 21.6 | 3.2 | 7.5 | 20.7 | 10.9 | 12.0 | 25.3 | 20.4 | 6.32 | 0.82 | |
| | 28 | 2.70 | 23.2 | 1.5 | 8.5 | 16.0 | 28.4 | 19.7 | 9.4 | 16.5 | 6.36 | 0.78 | |
| | 29 | 2.98 | 21.1 | tr | 1.0 | 9.6 | 18.2 | 19.9 | 16.1 | 35.2 | 6.35 | 0.84 | |

FIG. 1 is a graph illustrating a relation between the amount of each of manganese, chromium, molybdenum, nickel and cobalt, which are basic alloy elements of the alloy steel powder of the present invention, alloyed in a steel powder and the green density of the alloyed steel powder.

Figure 2:
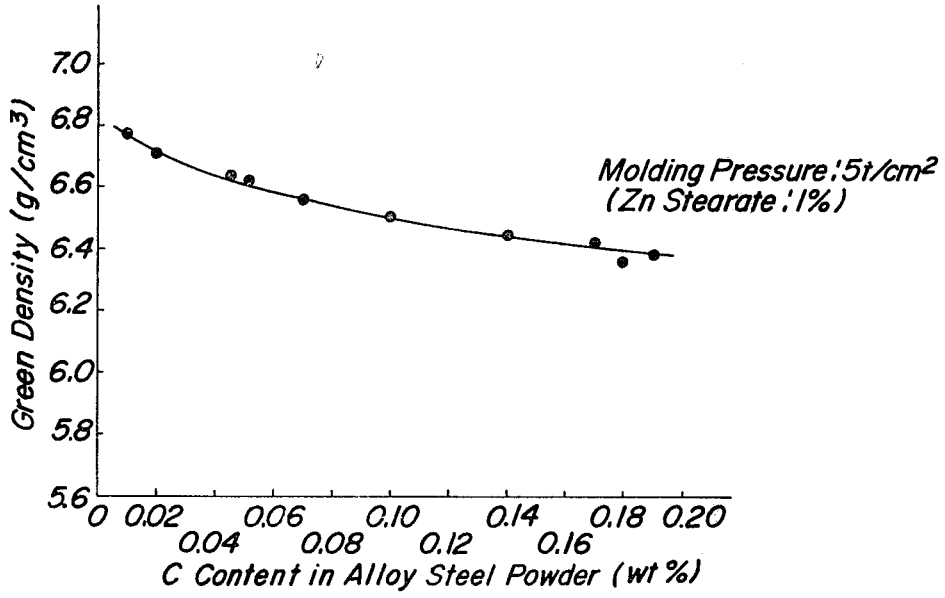
FIG. 2 is a graph illustrating a relation between the amount of carbon alloyed in an alloy steel powder and the green density thereof.
Figure 3:
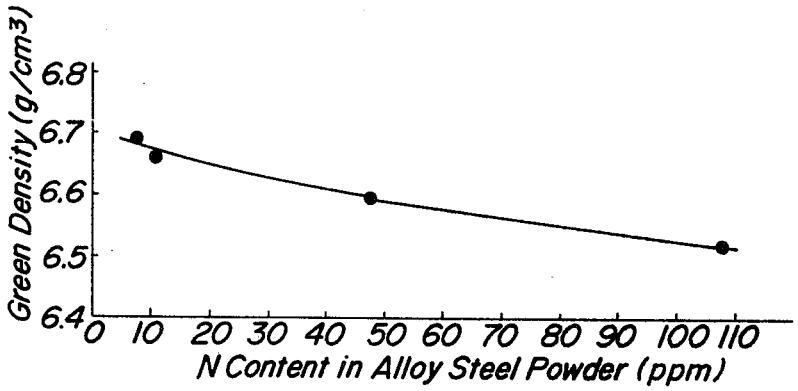
FIG. 3 is a graph illustrating a relation between the total amount of nitrogen alloyed in an alloy steel powder and the green density thereof.

FIGS. 2 and 3 shows the result of measurement of the influence of carbon content and total nitrogen content in an alloy steel powder upon its green density when carbon content and total nitrogen content in the alloy steel powder of Example 10 are varied.

It can be seen from FIGS. 2 and 3 that, in order to obtain an alloy steel powder having a green density of at least 6.60 g/cm³ under a molding pressure of 5 ton/cm², it is necessary that the alloy steel powder contains not more than 1.5% of manganese, not more than 5.0% of chromium, not more than 7.0% of molybdenum, not more than 5.0% of nickel, not more than 10.0% of cobalt and further not more than 0.05% of carbon and not more than 0.0040% of total amount of nitrogen.

The following Table 2 shows a relation between the total nitrogen content and the rattler value in the alloy steel powders of Examples 10 and 12, which are different from each other in the manganese content, when the alloy steel powders are press molded under various molding pressures.

TABLE 2

| Example | Molding Pressure (ton/cm²) | N (total) (ppm) 8 | 11 | 48 | 108 | 338 | 748 |
|---|---|---|---|---|---|---|---|
| 10 | 3 | crack | crack | crack | crack | crack | crack |
| | 4 | 1.13 | 0.85 | crack | crack | crack | crack |
| | 5 | 0.78 | 0.58 | 0.82 | 1.15 | crack | crack |
| | 6 | 0.60 | 0.44 | 0.48 | 0.52 | 0.62 | crack |
| | 7 | 0.50 | 0.37 | 0.40 | 0.41 | 0.45 | crack |

| Example | Molding pressure (ton/cm²) | N (total) (ppm) 8 | 24 | 46 | 120 | 300 |
|---|---|---|---|---|---|---|
| 12 | 3 | crack | crack | crack | crack | crack |
| | 4 | 1.19 | 1.20 | crack | crack | crack |
| | 5 | 0.85 | 1.03 | 1.15 | crack | crack |
| | 6 | 0.54 | 0.58 | 0.60 | 0.73 | crack |
| | 7 | 0.33 | 0.40 | 0.52 | 0.50 | 0.62 |

It can be seen from Table 2 that, when alloy steel powders having a manganese content defined in the present invention and further having a total nitrogen content of not higher than 0.0040% can be formed into a green compact having a high strength.

Figure 4:
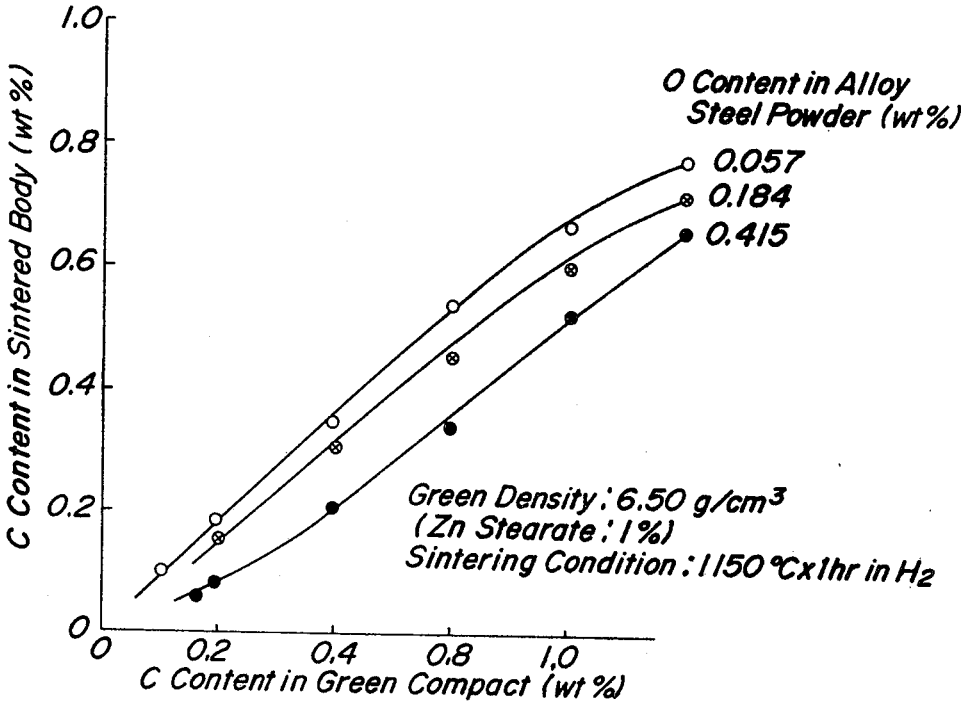
FIG. 4 is a graph illustrating a relation between the carbon content in a green compact and that in a sintered body.
Figure 5:
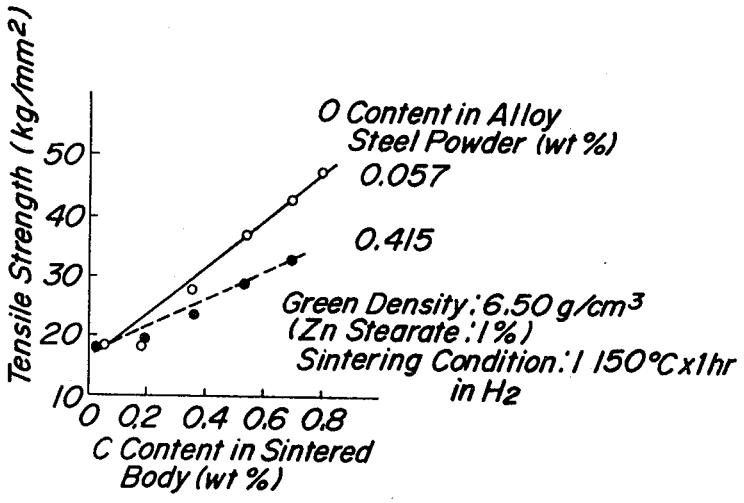
FIG. 5 is a graph illustrating a relation between the carbon content and the tensile strength in a sintered body.
Figure 6:
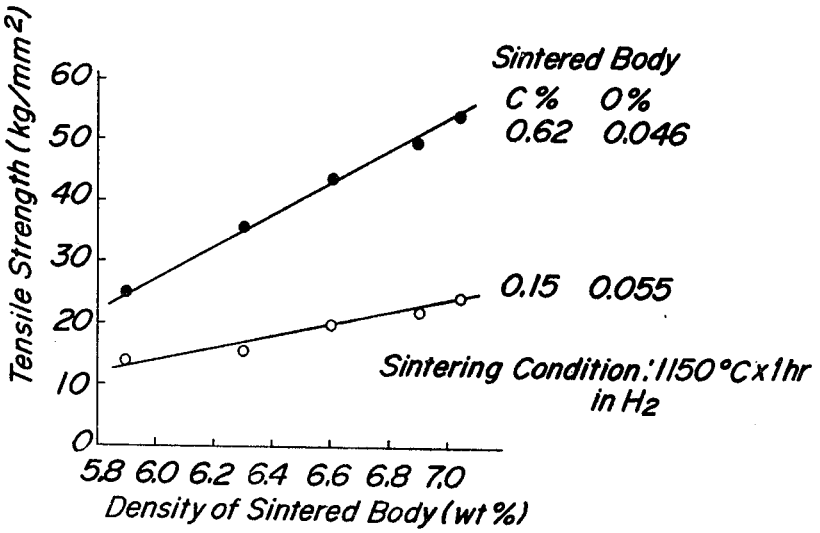
FIG. 6 is a graph illustrating a relation between the density and tensile strength of a sintered body.
Figure 7:
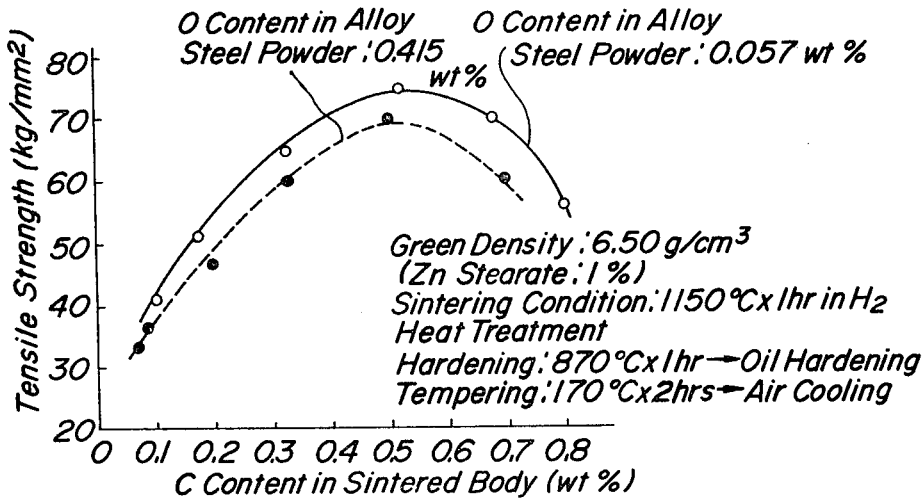
FIG. 7 is a graph illustrating a relation between the carbon content in a sintered body and the tensile strength of the hardened and tempered sintered body.

Further, in order to produce a sintered body having an improved toughness and capable of being used for practical purpose, an alloy steel powder having the same composition as that of the alloy steel powder of Example 10, except that the oxygen content was varied, was mixed with a given amount of graphite powder, the resulting mixture was press molded to produce a green compact, the green compact was sintered to produce a sintered body, and a relation between the carbon content in the green compact and that in the sintered body was investigated. The obtained results are shown in FIG. 4. It can be seen FIG. 4 that, as the oxygen content in a starting alloy steel powder is the higher, the loss of carbon during the sintering is the larger. The yield of carbon and the accuracy of the yield during sintering and forging steps are very important for the production of machine parts, and are one of the properties demanded to the alloy steel powder of the present invention from the economical view point. Further, FIG. 5 illustrates a relation between the carbon content and the tensile strength of a sintered body. It can be seen from FIG. 5 that, when the resulting sintered bodies have the same carbon content, a starting alloy steel powder having a low oxygen content is more improved than that having a high oxygen content in the sintering of fellow particles. FIG. 6 illustrates a relation between the density adn the tensile strength of a sintered body. Since the density of a sintered body is proportional to the tensile strength thereof as seen from FIG. 6, alloy steel powders having an excellent compressibility are demanded. FIG. 7 shows a relation between the carbon content in a sintered body and the tensile strength of the hardened and tempered sintered body. It can be seen from FIG. 7 that the toughness of a sintered body produced from the alloy steel powder of the present invention can be more improved by the heat treatment.

The sintered bodies used in the experiments shown in FIGS. 4–7 were produced under the following condition. An alloy steel powder was mixed with a given amount of graphite powder and 1% of zinc stearate, and the resulting mixture was press molded into a tensile test piece (green compact) having a green density of 6.50–6.70 g/cm³, which is defined in JSPM Standard 2-64. The test piece was sintered at 1,150° C. for 1 hour under hydrogen atmosphere to obtain the sintered body. The heat treatment of the sintered body was carried out in the following manner. The sintered body was hardened at 870° C. for 1 hour, and further hardened in oil, tempered at 170° C. for 2 hours in oil, and then cooled in air.

Further, each of the alloy steel powders shown in Table 1 was mixed with 0.8% of graphite powder and 1% of stearic acid, and the resulting mixture was press molded into a tensile test piece having a green density of 6.50–6.70 g/cm$^3$, which is defined in JSPM Standard 2–64, and the test piece was sintered and heat-treated under the above described conditions. The following Table 3 shows the tensile strength of above obtained sintered bodies and heat-treated bodies.

TABLE 3

| | Example | Density of sintered body (g/cm$^3$) | Tensile strength (kg/mm$^2$) Sintered body | Sintered-heat treated body |
|---|---|---|---|---|
| | 1 | 6.68 | 24.6 | 32.2 |
| | 2 | 6.67 | 44.4 | 95.5 |
| | 3 | 6.69 | 49.4 | 97.5 |
| | 4 | 6.63 | 46.7 | 69.4 |
| | 5 | 6.54 | 52.4 | 54.1 |
| | 6 | 6.53 | 50.2 | 51.3 |
| | 7 | 6.59 | 47.8 | 52.4 |
| | 8 | 6.69 | 32.2 | 67.2 |
| | 9 | 6.68 | 30.8 | 38.4 |
| Alloy steel power of the present invention | 10 | 6.60 | 44.2 | 75.3 |
| | 11 | 6.62 | 41.8 | 73.8 |
| | 12 | 6.56 | 34.4 | 70.1 |
| | 13 | 6.64 | 26.3 | 38.2 |
| | 14 | 6.70 | 38.6 | 77.0 |
| | 15 | 6.70 | 37.5 | 68.8 |
| | 16 | 6.66 | 67.8 | 77.9 |
| | 17 | 6.68 | 69.9 | 89.0 |
| | 18 | 6.58 | 46.3 | 72.2 |
| | 19 | 6.54 | 52.4 | 54.1 |
| | 20 | 6.60 | 43.8 | 76.6 |
| | 21 | 6.58 | 45.5 | 80.3 |
| | 22 | 6.65 | 41.9 | 84.4 |
| | 23 | 6.67 | 42.5 | 81.0 |
| | 24 | 6.60 | 48.8 | 50.2 |
| Comparative alloy steel powder | 25 | 6.64 | 24.0 | 26.6 |
| | 26 | 6.60 | 33.0 | 62.3 |
| | 27 | 6.51 | 39.8 | 74.4 |
| | 28 | 6.64 | 36.8 | 68.1 |
| | 29 | 6.52 | 62.5 | 65.4 |

An explanation will be made hereinafter with respect to the result of various experiments carried out by the use of alloy steel powders having the same composition as that of the alloy steel powder of Example 10, except that oxygen content was varied, referring to FIGS. 8–10.

Figure 8:
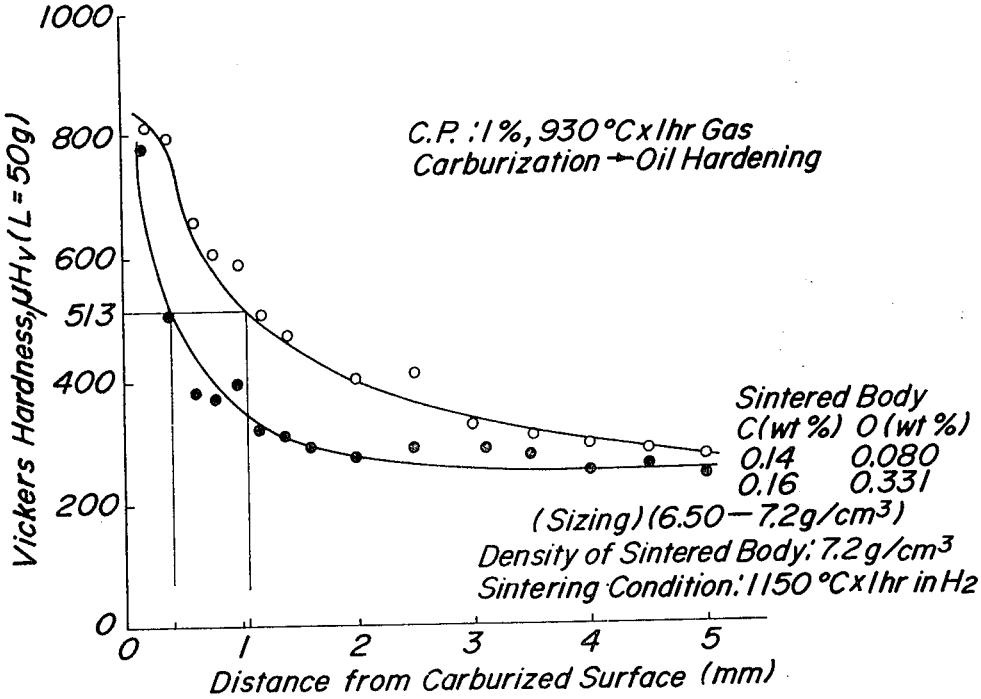
FIGS. 8 and 9 are graphs showing the gas carburizing properties of sintered body and a forged body, respectively.
Figure 9:
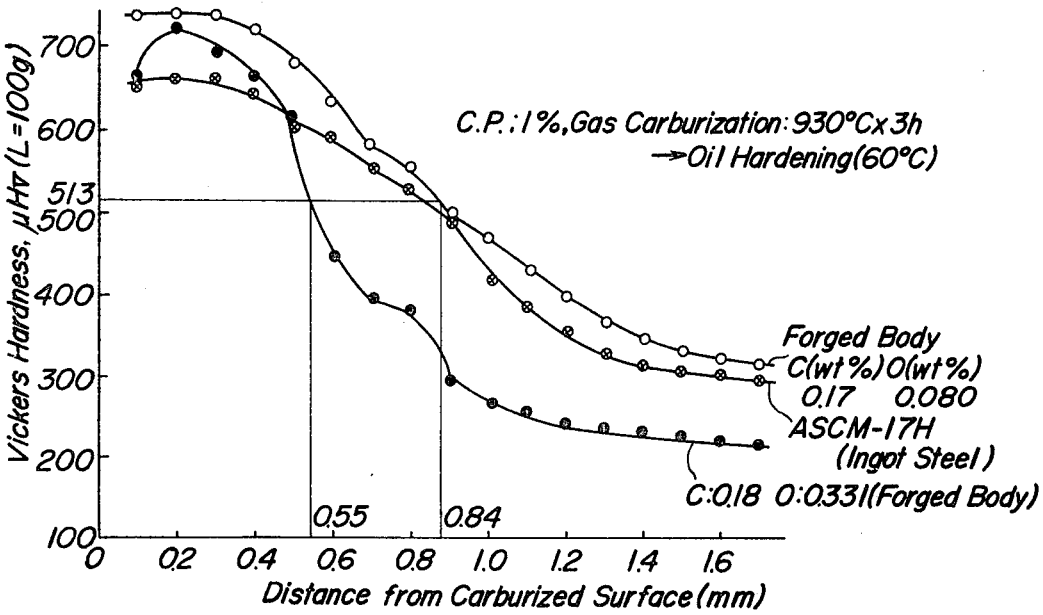

FIGS. 8 and 9 illustrate the gas carburizing properties of a sintered body and a forged body, respectively. The gas carburization was carried out under a condition that a sintered body having a density of at least 7.20 g/cm$^3$ or a forged body having density ratio of at least 99% was heated at 930° C. for 1 hour under a carbon potential of 1%. It can be seen from FIGS. 8 and 9 that an effective carburization depth for obtaining a Vickers hardness of 513 in a sintered or forged body varies noticeably depending upon the oxygen content in the sintered or forged body. In the case of sintered body, when the oxygen content is 0.080%, the effective carburization depth is 1.06 mm, and when the oxygen content is 0.331%, the effective carburization depth is 0.40 mm. While, in the case of forged body, when the oxygen content is 0.080%, the effective carburization depth is 0.84 mm and is equal to that of ASCM-17H (ingot steel), but when the oxygen content is 0.331%, the carburization depth is only 0.53 mm.

Then, the forged body was subjected to a hardening-tempering treatment or to a carburization hardening-tempering treatment. The following Table 4 shows the tensile strength of the above treated forged body.

TABLE 4

| Sample | Carburization and heat-treatment conditions | Tensile strength (kg/mm$^2$) | Forged body C % | O % | Starting alloy alloy steel powder (O %) |
|---|---|---|---|---|---|
| Forged body | Hardening: 930° C. × 3 hrs → 830° C. × 15 min → oil hardening | 80.6 | 0.16 | 0.048 | 0.063 |
| | Tempering: 170° C. × 2 hrs → air cooling | 56.3 | 0.17 | 0.387 | 0.401 |
| | | 71.8 | 0.18 | 0.0048 | ASCM-17H (ingot steel) |
| Carburized forged body | Carburization annealing: 930° C. × 3 hrs gas carburization (c.p.: 0.85%) → oil hardening | 119.4 | 0.16 | 0.048 | 0.063 |
| | Tempering: 170° C. × 2 hrs in oil → air cooling | 86.6 | 0.17 | 0.387 | 0.401 |
| | | 120.5 | 0.18 | 0.0048 | ASCM-17H (ingot steel) |
| | Carburization annealing: 930° C. × 3 hrs gas carburization (c.p.: 1%) → oil hardening | 107.1 | 0.16 | 0.048 | 0.063 |
| | | 82.9 | 0.17 | 0.387 | 0.401 |
| | | 104.9 | 0.18 | 0.0048 | ASCM-17H (ingot steel) |

(In each sample, a normalizing treatment of "930° C. × 1 hr → air cooling" was carried out.)

Figure 10:
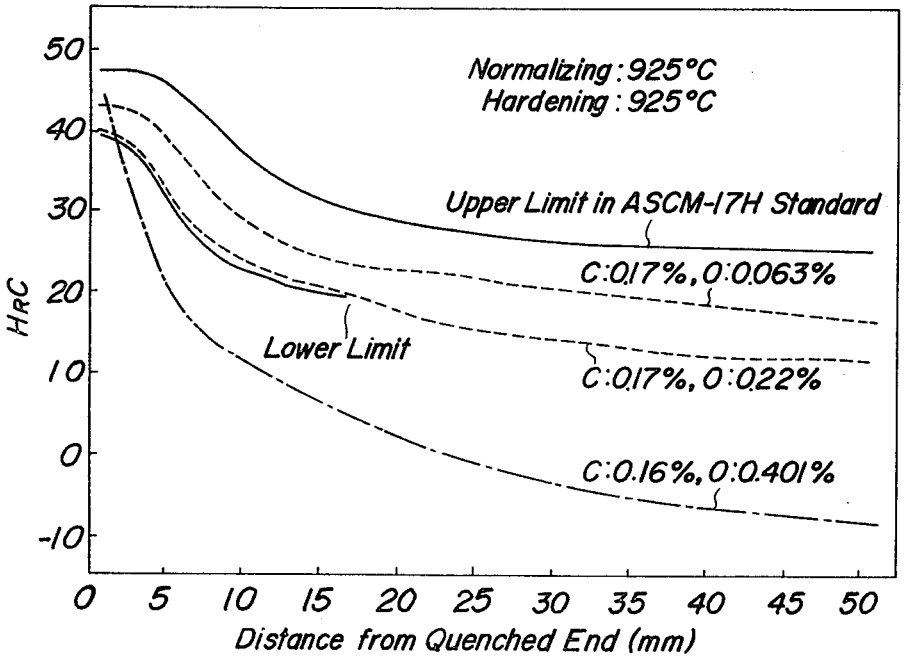
FIG. 10 is a graph showing the result of hardening test of a forged body.

Further, the forged body used in the experiment of FIG. 9 was subjected to a Jominy's end hardening test according to the method defined in JIS G 0561, and the obtained result is shown in FIG. 10. In this test, the normalizing was carried out at 925° C. and the hardening was carried out at 925° C., and the carbon content was set to 0.16–0.17%, which corresponds to the carbon content of a case hardened steel. It can be seen from FIG. 10 that the a forged body produced from an alloy steel powder having an oxygen content of 0.22% according to the present invention has a hardenability higher than the lower limit of H-band of ASCM-17H (ingot steel), and the hardenability of a forged body produced from an alloy steel powder having an oxygen content of 0.401% is very poor. Accordingly, the oxygen content in an alloy steel powder has not a serious influence upon its compressibility, but the oxygen content in a sintered body or in a forged body has various adverse influence upon the properties thereof, and therefore there is naturally a certain upper limit in the oxygen content in the alloy steel powder, and the upper limit is 0.25%.

As described above, the alloy steel powder produced by a water-spraying and a reduction annealing followed thereto according to the present invention has low carbon, nitrogen and oxygen contents, and is excellent in the compressibility and moldability at the press molding in a mold, and further excellent in the carburizing property and hardenability in the sintered steel or powder forged steel.

What is claimed is:

1. An alloy steel powder having excellent compressibility, moldability and heat-treatment property, consisting of not more than 0.05% by weight of carbon, not more than 0.0040% by weight of nitrogen, not more than 0.10% by weight of silicon, not more than 0.01% by weight of aluminum, not more than 0.25% by weight of oxygen, at least one of 0.35–1.50% by weight of manganese, 0.2–5.0% by weight of chromium, 0.1–7.0% by weight of molybdenum and 0.01–1.0% by weight of vanadium, and the remainder being iron and incidental impurities, and having a green density of at least 6.60 g/cm$^3$ and a rattler value of not higher than 1.20% in the green compact produced therefrom under a molding pressure of 5 ton/cm$^2$.

2. An alloy steel powder having excellent compressibility, moldability and heat-treatment property, consisting of not more than 0.05% by weight of carbon, not more than 0.0040% by weight of nitrogen, not more than 0.10% by weight of silicon, not more than 0.01% by weight of aluminum, not more than 0.25% by weight of oxygen, at least one of 0.35–1.50% by weight of manganese, 0.2–5.0% by weight of chromium, 0.1–7.0% by weight of molybdenum and 0.01–1.0% by weight of vanadium, at least one of not more than 0.02% by weight of boron, 0.2–5.0% by weight of nickel, 0.2–2.0% by weight of copper, 0.2–10.0% by weight of cobalt and not more than 0.10% by weight of niobium, and the remainder being iron and incidental impurities, and having a green density of at least 6.60 g/cm$^3$ and a rattler value of not higher than 1.20% in the green compact produced therefrom under a molding pressure of 5 ton/cm$^2$.

* * * * *